US007351390B2

(12) United States Patent
Loncle et al.

(10) Patent No.: US 7,351,390 B2
(45) **Date of Patent: *Apr. 1, 2008**

(54) METHOD AND INSTALLATION FOR HEAT TREATING CARBON BODIES CONTAINING SODIUM

(75) Inventors: Jean-Etienne Loncle, Le Haillan (FR); Jacky Minet, Le Pian Medoc (FR)

(73) Assignee: Snecma Propulsion Solide, Le Haillan (FR)

( * ) Notice: Subject to any disclaimer, the term of this patent is extended or adjusted under 35 U.S.C. 154(b) by 671 days.

This patent is subject to a terminal disclaimer.

(21) Appl. No.: 10/256,224

(22) Filed: Sep. 26, 2002

(65) Prior Publication Data

US 2004/0009116 A1 Jan. 15, 2004

(30) Foreign Application Priority Data

Jul. 12, 2002 (FR) ..... 02 08818

(51) Int. Cl.
*C09C 1/56* (2006.01)

(52) U.S. Cl. ..... 423/447.7; 423/460; 423/447.1

(58) Field of Classification Search ..... 423/460, 423/461, 200, 209; 502/34, 55, 516
See application file for complete search history.

(56) References Cited

U.S. PATENT DOCUMENTS

| | | | | |
|---|---|---|---|---|
| 3,179,605 | A | 4/1965 | Ohsol | 252/502 |
| 3,413,094 | A | 11/1968 | Gibson | 23/209.9 |
| 4,388,289 | A | 6/1983 | Shepherd et al. | 423/447.4 |
| 4,507,272 | A | 3/1985 | Mullen et al. | 423/447.4 |
| 4,913,736 | A * | 4/1990 | Gimzeski | 75/631 |
| 5,154,776 | A * | 10/1992 | Bloch | 134/22.1 |
| 2004/0009113 | A1 * | 1/2004 | Sion | 423/447.1 |

FOREIGN PATENT DOCUMENTS

FR 2 024 938 9/1970

* cited by examiner

*Primary Examiner*—Stuart L. Hendrickson
*Assistant Examiner*—Daniel C. McCracken
(74) *Attorney, Agent, or Firm*—Weingarten, Schurgin, Gagnebin & Lebovici LLP

(57) ABSTRACT

Carbon bodies are heated in an oven under low pressure and while being swept with an inert gas, gaseous effluent containing elemental or compound sodium in sublimed form being continuously extracted from the oven via an effluent exhaust pipe. At least one sodium-neutralizing agent is injected into the effluent exhaust pipe immediately downstream from the outlet for exhausting gaseous effluent from the oven. The sodium-neutralizing agent is selected from carbon dioxide and steam, and it can be injected continuously into the flow of gaseous effluent.

8 Claims, 2 Drawing Sheets

METHOD AND INSTALLATION FOR HEAT TREATING CARBON BODIES CONTAINING SODIUM

BACKGROUND OF THE INVENTION

The invention relates to high-temperature heat treatment of carbon bodies containing sodium, and more particularly to treating the gaseous effluents produced during the heat treatment.

A particular field of application for the invention is making carbon fiber fabrics or preforms to constitute fiber reinforcement for composite material parts such as carbon/resin composite parts, e.g. C/epoxy or C/phenolic resin parts, or thermostructural composite parts, such as carbon/carbon (C/C) composite parts or carbon-reinforced ceramic matrix composite parts.

Such fiber fabrics are conventionally obtained using carbon-precursor fibers since they are better at withstanding the textile manufacturing operations required for forming fabrics than are carbon fibers. Carbon-precursor fibers in common use are preoxidized polyacrylonitrile (PAN) fibers, fibers made of pitch, phenolic resin fibers, and rayon fibers.

In certain applications at least, it is necessary not only to transform the precursor into carbon, but also to perform subsequent heat treatment at high temperature, typically above 1000° C., and under low pressure, for the purpose of eliminating metals or metallic impurities, in particular sodium coming from the precursor, and/or in order to impart particular physico-chemical properties to the fibers.

Thus, in the case of bodies made of carbon derived from a preoxidized PAN precursor, it is common practice to perform two successive stages:

- a first stage of carbonization proper in which the precursor is chemically transformed into carbon, this first stage being performed on an industrial scale in an oven by progressively raising the heating temperature of the oven up to about 900° C.; and
- a second stage of heat treatment at high temperature seeking in particular to eliminate by sublimation any sodium coming from the precursor, this second stage likewise being performed in an oven by progressively raising its temperature up to about 1600° C., or indeed about 2000° C. to 2200° C., or even 2500° C. when seeking to eliminate other metallic impurities or to perform very high temperature heat treatment on the carbon fibers.

The second stage is generally performed under low pressure while sweeping with an inert gas such as nitrogen.

When the carbon bodies are constituted by reinforcing fiber fabric for parts made of composite material, the second stage is generally performed prior to densifying the fiber fabric with the resin, carbon, or ceramic matrix of the composite material. For a thermostructural composite material having a matrix made of carbon and/or ceramic, densification can be performed by a liquid method, i.e. by impregnation with a liquid compound such as a resin that constitutes a precursor for the material of the matrix, and then by transforming the precursor by means of heat treatment. Densification can also be performed by a gaseous method, i.e. by chemical vapor infiltration, where both these methods, the liquid method and the gaseous method, are well known and may optionally be used in association with each other.

In existing installations, the cooling of the gaseous effluents leads to a deposit containing sodium being formed on the walls of the pipes downstream from the outlet for effluent leaving the heat treatment oven. It is necessary to clean these pipes regularly, and such cleaning is not easy because of the risk of the sodium-containing deposit reacting violently.

OBJECT AND SUMMARY OF THE INVENTION

An object of the invention is to propose a method which avoids the above-mentioned drawback by preventing the walls of gaseous effluent exhaust pipes receiving deposits that can potentially constitute a hazard while the pipes are being cleaned.

This object is achieved by a method of a type in which carbon fiber bodies are heated in an oven while being swept with an inert gas under a pressure lower than atmospheric pressure, with gaseous effluent being extracted continuously from the oven, said effluent containing in particular sodium in sublimed form extracted from the carbon fibers and traveling along an effluent exhaust pipe, in which method, at least one sodium-neutralizing agent is injected into the effluent immediately downstream from the outlet for extracting gaseous effluent from the oven, while sodium contained in the effluent is still in sublimed form.

As a result, the deposit which forms on the walls of the effluent exhaust pipe or of other devices downstream from the effluent outlet from the oven can easily be eliminated at a later stage and without danger. The Applicant has found that not only is elemental sodium evacuated in sublimed form together with the gaseous effluent, but so also are sodium compounds liable to form potentially troublesome or even dangerous deposits, such as sodium oxide $NaO_2$. The term "neutralizing" sodium is used herein to cover not only neutralizing elemental sodium, but also neutralizing compounds such as $NaO_2$.

The term "a sodium-neutralizing agent" is used to mean any substance that makes it possible to obtain a sodium compound that is stable and relatively easy to eliminate. It is preferable to select a sodium-neutralizing agent that is quite easy to handle, for example steam or preferably carbon dioxide, optionally mixed with steam.

The sodium-neutralizing agent may be injected at or downstream from a bend formed by the pipe for exhausting gaseous effluent from the oven.

The injected sodium-neutralizing agent may also be diluted in an inert gas such as nitrogen.

The sodium-neutralizing agent may be injected continuously into the flow of gaseous effluent extracted from the oven during heat treatment so as to form a sodium compound that is stable and easy to eliminate and so as to avoid sodium being deposited on the wall of the exhaust pipe.

In another implementation of the method, the sodium-neutralizing agent is injected into the exhaust pipe prior to cleaning it and after the end of heat treatment in order to neutralize sodium that has been deposited on the wall of the exhaust pipe.

Another object of the invention is to provide an installation enabling the method to be implemented.

This object is achieved by an installation for heat treating carbon bodies containing sodium, the installation being of the type comprising an oven, means for feeding the oven with inert gas for sweeping purposes, and a pipe for exhausting gaseous effluent from the oven, which installation further comprises, in accordance with the invention, means for injecting a sodium-neutralizing agent into the exhaust pipe immediately after the outlet from the oven.

BRIEF DESCRIPTION OF THE DRAWINGS

Other features and advantages of the heat treatment method and installation of the invention will be seen on reading the following description given by way of non-limiting indication and made with reference to the accompanying drawings, in which.

DETAILED DESCRIPTION OF EMBODIMENTS

Embodiments of the invention are described below in the context of an application to high-temperature heat treatment of carbon fiber fabrics obtained by carbonizing fabrics made of carbon-precursor fibers. The term "high-temperature heat treatment" is used to mean treatment at a temperature that is higher than the temperatures commonly encountered by the fabric during carbonization, i.e. a temperature higher than 1000° C., typically lying in the range 1400° C. to 2000° C. or 2200° C. or even 2500° C. The heat treatment is performed while sweeping with an inert gas such as nitrogen or argon and under low pressure, i.e. a pressure lower than atmospheric pressure, and preferably below 50 kilopascals (kPa), typically lying in the range 0.1 kPa to 50 kPa, and preferably less than 5 kPa. The method of the invention is applicable to eliminating any sodium present in the fibers at low concentration, e.g. less than 80 parts per million (ppm), or at much higher concentration, e.g. greater than 3500 ppm.

Figure 1:
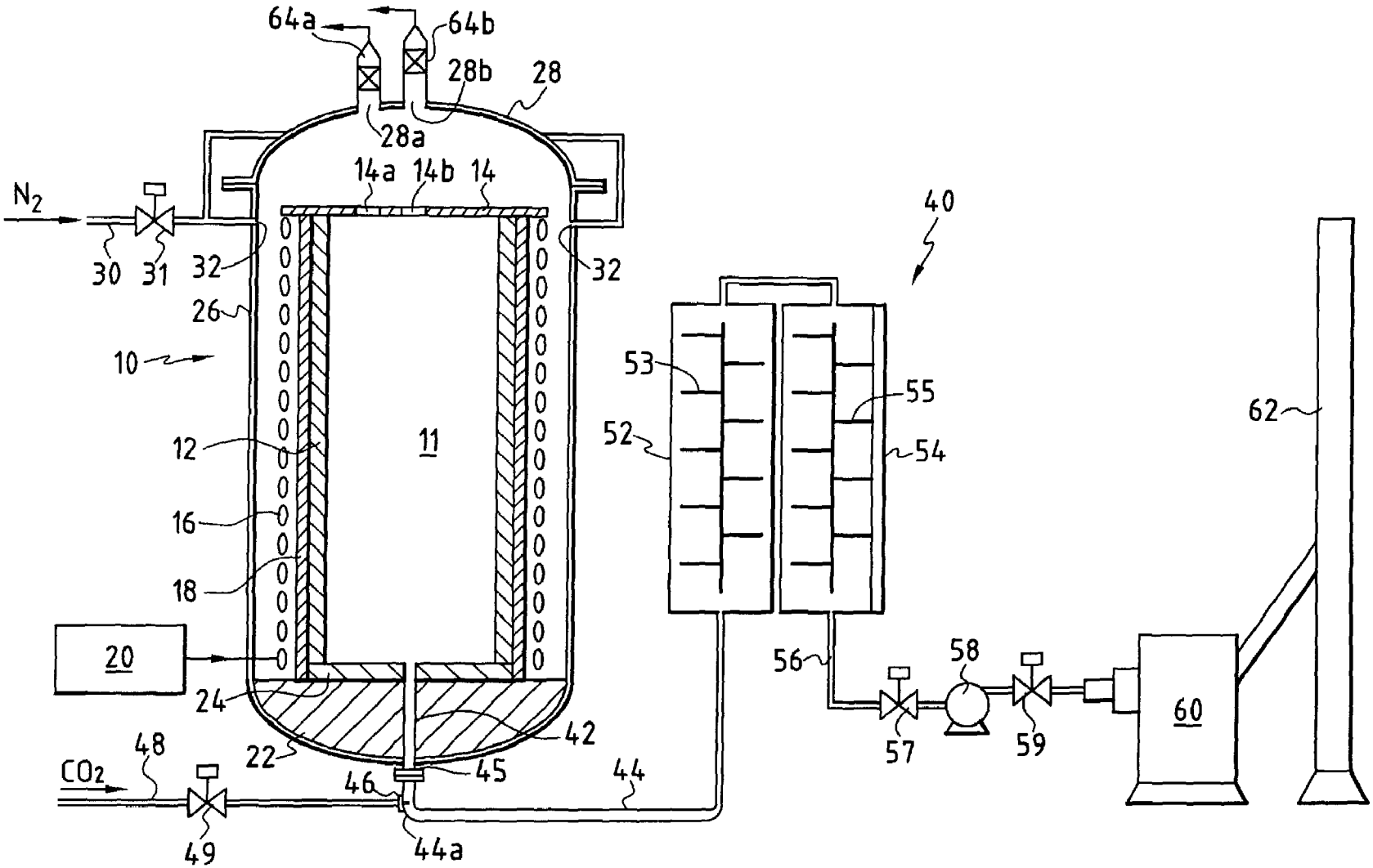
FIG. 1 is a highly diagrammatic overall view of an installation constituting an embodiment of the invention.

FIG. 1 is a highly diagrammatic representation of an oven 10 comprising a susceptor 12 in the form of a vertical axis cylinder defining the side walls of a volume or enclosure 11 for filling with carbon bodies (not shown).

The susceptor 12, e.g. made of graphite, is surmounted by a cover 14, and is heated by inductive coupling with an induction coil 16 which surrounds the susceptor, with thermal insulation 18 being interposed between them. The induction coil is powered by a control circuit 20 which delivers electricity as a function of the heating requirements of the oven.

The induction coil can be subdivided into a plurality of sections along the height of the oven. Each section is electrically powered independently so as to enable different heating zones to be defined in the oven in which temperature can be regulated independently.

The bottom of the oven is formed by thermal insulation 22 covered by a soleplate 24, e.g. made of graphite, and on which the susceptor 12 stands.

The assembly is received in a casing 26, e.g. made of metal and closed in leaktight manner by a removable cover 28.

A pipe 30 fitted with a valve 31 is connected to an inert gas source (not shown), e.g. a supplying nitrogen $N_2$. The pipe 30 feeds the oven 10 with inert gas for sweeping purposes via the top portion of the oven, optionally via a plurality of inlets 32 opening out at different positions around the casing 26 of the oven.

An extractor device 40 is connected to an outlet duct 42 passing through the bottom of the oven for the purpose of extracting the gaseous effluent produced while subjecting carbon bodies to heat treatment, so as to make it possible in particular to eliminate any residual sodium.

The device 40 is connected to the outlet duct 42 via an exhaust pipe 44 provided with a carbon dioxide ($CO_2$) injection inlet 46. As shown in detail in FIG. 2, the pipe 44 forms a bend 44*a* at its end which is connected via a flange 45 to the outlet duct 42 from the oven. The injection inlet 46 is connected to a pipe 48 connected in turn to a source (not shown) delivering $CO_2$ gas and provided with a valve 49. The pipe 48 is extended by a nozzle 50 which penetrates into the pipe 44 in order to inject $CO_2$ gas into said pipe towards the downstream end of the bend 44*a*, thus ensuring that no $CO_2$ is accidentally injected into the inside of the oven via the outlet duct 42. It is possible to provide a plurality of points for injecting $CO_2$ gas that are spaced apart from one another along the pipe 44.

$CO_2$ injection is performed as close as possible to the outlet from the oven, at a location where any sodium contained in the effluent is still in sublimed form. Injection via a bend in the pipe 44 encourages mixing between the $CO_2$ and the gaseous effluent by turbulence.

Two columns 52 and 54 provided with baffle plates 53 and 55 constraining the gases to follow a tortuous path are connected in series between the pipe 44 and a pipe 56 provided with a valve 57.

A pump 58 is mounted in the pipe 56 between the valve 57 and a valve 59 so as to enable the pump 58 to be put into circuit or to be isolated. The pump 58 serves to generate the low pressure level desired in the oven. Although only one pump is shown, it can be preferable for two pumps to be provided for redundancy reasons. The gaseous effluent extracted by the pump 58 is taken to a burner 60 which feeds a chimney 62.

The oven 10 is fitted with temperature sensors connected to the control circuit 20 in order to adjust the heating temperature to the desired value.

By way of example, two sensors 64*a* and 64*b* are used that are constituted by optically-aimed pyrometers, which sensors are housed on the cover 28 looking through windows 28*a*, 28*b* formed therein and through openings 14*a*, 14*b* formed through the cover 14 of the susceptor. It is not absolutely essential to use a plurality of pyrometric sensors, but using a plurality makes it possible to take measurements at different levels and to eliminate aberrant measurements by making comparisons. It is preferable to use bichromatic type pyrometers that produce a continuous signal that is constantly available.

The temperatures measured by the sensors 64*a*, 64*b* are applied to the control circuit 20 in order to enable the induction coil to be powered so as to cause temperature to vary in compliance with a preestablished temperature-rise profile.

Depending on the pressure that exists inside the enclosure, sodium contained in the fiber fabric begins to be released from a temperature of about 1000° C., and it is evacuated together with the gaseous effluent in sublimed form, either in the elemental state or optionally in a compound state, e.g. in the form of sodium oxide $NaO_2$. $CO_2$ is injected into the pipe 44 at a controlled rate by opening the valve 49, thereby neutralizing the Na (or $NaO_2$) as soon as it leaves the oven, and preventing it from being deposited on the walls of the pipe 44.

For safety reasons, $CO_2$ can start to be injected at a temperature below 900° C. Such injection is preferably continued at least until the process has ended. The resulting sodium carbonate is collected, in particular in the baffle columns 52, 54. The gaseous effluent purified of its sodium is taken to the burner 60.

It should be observed that neutralizing sodium with $CO_2$ also gives rise to a reduction in the content of cyanide ions ($CN^-$) in the deposit that is collected by the columns 52 and 52 compared with the content that would be observed in the absence of passivation, and thus adds to the safety obtained by the absence of any Na deposit.

The extractor device 40, or at least a portion thereof containing the baffle columns 52, 54 and possibly also the pipe 44, is cleaned periodically in order to eliminate the deposited sodium carbonate, in particular. Cleaning can be performed by rinsing with water in situ or by washing in water in a washing container after the extractor device has been disassembled, at least in part.

In another embodiment of the invention (FIG. 3), the sodium is neutralized by being hydrated. To this end, the pipe 44 is provided with one or more injector devices 70, e.g. in the form of hollow rings 72 surrounding the pipe 44. The injector device 70 is placed immediately downstream from the bend 44*a* with an isolating valve 71 being interposed between the outlet 42 from the oven and the injector device 70. In the example shown, the two rings are spaced apart from each other along the pipe 44. The injector rings 72 are fed in parallel by a pipe 74 connected both to a source of sodium-neutralizing agent, e.g. a source of steam via a pipe 76 having a valve 75, and to a source of inert gas such as nitrogen or argon via a pipe 78 provided with a valve 57.

Downstream from the injector device 70, in the flow direction of the gaseous effluent, the pipe 44 presents a purge orifice connected to a purge pipe 80 provided with a valve 81. Downstream from its connection with the purge pipe, the pipe 44 can be connected directly to the pump 58 via the valve 57, it not being essential to use baffle columns in this case. The remainder of the installation is identical to that described above.

Each injector ring 72 forms a toroidal duct surrounding the pipe 44 and communicating therewith through holes 74 passing through the wall of the pipe. The holes 74 can be inclined relative to the normal to the wall of the pipe 44 so as to direct the flow of sodium-neutralizing agent downstream.

The $H_2O+N_2$ mixture is injected during the heat treatment process as described above with reference to injecting $CO_2$.

In order to ensure that no sodium is deposited on the wall of the pipe 44 upstream from the injector device closest to the outlet from the oven, the pipe 44 may be lagged along its portion connecting the outlet pipe 42 to said injector device. The lagging 43 serves to avoid any premature condensation of sodium on the wall of the pipe 44 due to the gaseous effluent cooling too quickly. The lagging 43 can be replaced by or associated with heater means, for example electrical resistances.

After the end of heat treatment in which the sodium contained in the gaseous effluent is hydrated by continuously injecting into the flow of gaseous effluent, the pipe 44 is purged or cleaned.

For this purpose, the valves 75 and 81 are opened, while the vales 71, 57, and 77 are closed, and water in liquid form is admitted into the pipe 76 and passes from that pipe into the injector device 70. The pipe 44 can be rinsed on a plurality of successive occasions in order to eliminate the sodium hydroxide obtained by neutralizing the sodium.

After rinsing, the pipe 44 can be dried merely by opening the valve 57 and setting the pump 58 into operation while the valves 75 and 81 are closed.

Figure 3:
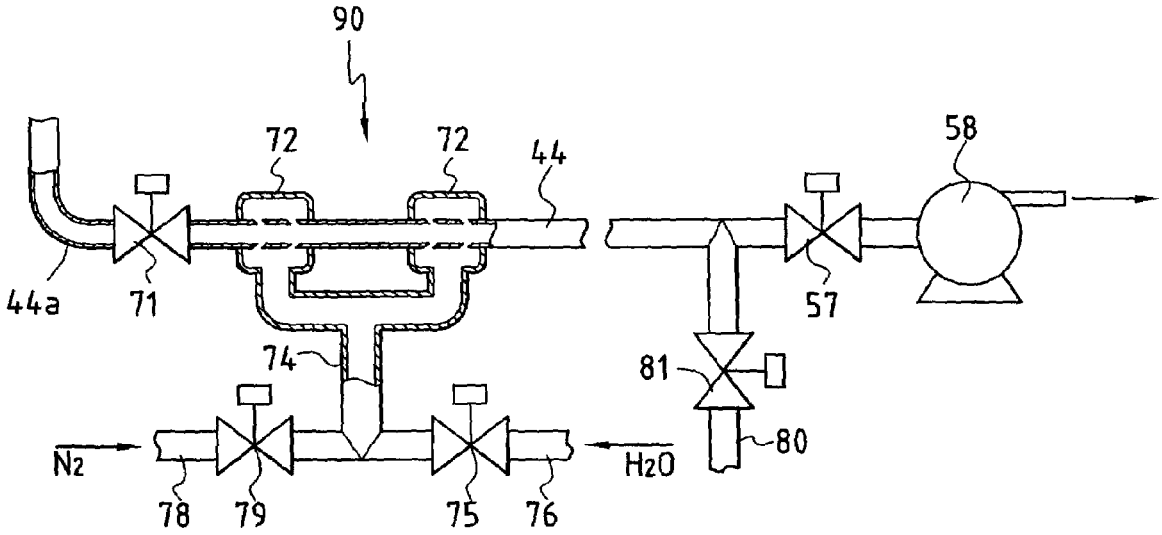
FIG. 3 is a detail view showing a portion of a device for exhausting gaseous effluent from the oven of the FIG. 1 installation in another embodiment of the invention.

Although it is possible to inject steam on its own using the embodiment of FIG. 3, it is preferable to dilute it with nitrogen in order to avoid too violent a reaction with the sodium, given that the quantity of sodium to be neutralized is small.

Figure 2:
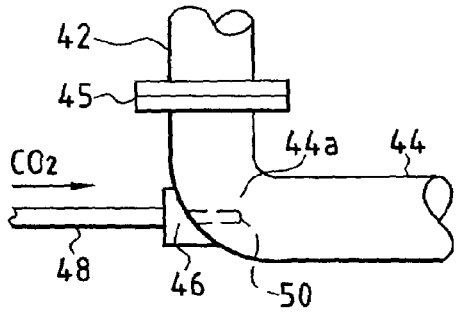
FIG. 2 is a detail view showing a portion of a device for exhausting gaseous effluent from the oven in the FIG. 1 installation.

In the embodiment of FIGS. 1 and 2, the injected $CO_2$ can also be diluted by being mixed with nitrogen.

Other variant embodiments are possible, in particular by modifying the embodiment of FIGS. 1 and 2 so as to inject continuously not $CO_2$, but rather steam or a mixture of $CO_2$ and steam, possibly diluted with an inert gas.

Nevertheless, it should be observed that compared with $H_2O$, neutralizing sodium by means of $CO_2$ is advantageous insofar as it produces sodium carbonate which is easier to handle, less corrosive, and not as reactive as sodium hydroxide.

The method and the installation described above are particularly suitable for carbon bodies obtained from bodies made of preoxidized PAN precursor, in particular for carbon fiber fabric for use in making parts out of composite material of the carbon/resin, C/C or carbon/ceramic type, e.g. having a matrix of silicon carbide (C/SiC) or a ternary matrix of silicon, boron, and carbon (C/Si—B—C).

The fabric is made using fibers while they are in the carbon precursor state, which fibers are better at withstanding fabric manufacturing operations than are carbon fibers. The fabric can be one-dimensional such as yarns or tows, two-dimensional, such as woven cloth or sheets made up of parallel tows or yarns, or indeed three-dimensional, such as preforms obtained by winding filaments, or by stacking, winding, or draping cloth or sheets in superposed plies and optionally bonded together by needling or stitching, for example. Examples of fiber preforms are preforms for the throats or the diverging portions of rocket engine nozzles or preforms for brake disks.

The invention also applies to carbon bodies obtained from carbon-precursor materials other than preoxidized PAN, and also containing sodium or possibly one or more other metals or metallic impurities to be eliminated. Such precursors comprise pitch, phenolic resin materials, and rayon.

The method of the invention is advantageous in that it makes it possible to eliminate the sodium present at very low concentration in the fibers, e.g. at a concentration of less than 80 parts per million (ppm), which sodium is impossible to eliminate using some other method such as rinsing in water. The method can also be used for eliminating sodium present at much higher concentration in the fibers, for example at concentrations in excess of 3500 ppm.

In addition to sodium, it is possible to eliminate calcium and/or magnesium by sublimation.

When carbon bodies need to present a very high degree of purity, it may also be necessary for metals such as Fe, Ni, and Cr to be eliminated in addition to sodium. It is then necessary to perform heat treatment up to a temperature which is high enough to enable such metals to evaporate, for example a temperature reaching 2000° C. or 2200° C., or even 2500° C.

The invention claimed is:

1. A method for continuously purifying a carbon fiber body by heat treating the carbon fiber body to remove sodium contained in carbon fibers, the method comprising the steps of:

placing the carbon fiber body to be treated in an oven having a gas inlet and an effluent gas outlet connected to an exhaust pipe;

heating the carbon fiber body in the oven at a temperature at which sodium contained in the carbon fibers is sublimed, under an atmosphere of inert gas supplied through the gas inlet; continuously extracting a gaseous effluent containing said inert gas and sodium in sublimed form from the oven through the effluent gas outlet and via the exhaust pipe, while maintaining within the oven a pressure lower than atmospheric pressure, and injecting at least one sodium-neutralizing agent continuously into the gaseous effluent extracted from the oven during heat treatment at a location immediately downstream from the gas effluent outlet while maintaining any sodium contained in the gaseous effluent in sublimed form at the location of injection.

2. A method according to claim 1, wherein the sodium-neutralizing agent is selected from carbon dioxide and steam.

3. A method according to claim 2, wherein the injected sodium-neutralizing agent is diluted in an inert gas.

4. A method according to claim 3, wherein the inert gas is nitrogen or argon.

5. A method according to claim 1, wherein the sodium-neutralizing agent is injected at or downstream from a bend formed by the pipe for exhausting effluent from the oven.

6. A method according to claim 1, wherein the sodium-neutralizing agent is injected into the exhaust pipe after the end of heat treatment in order to neutralize sodium deposited on the wall of the exhaust pipe prior to cleaning it.

7. A method according to claim 1, wherein the carbon fiber body is heated at a temperature lying in range of about 1400° C. and about 2500° C.

8. A method according to claim 1, wherein the pressure inside the oven is maintained at a value below about 50 kilopascals.

* * * * *

UNITED STATES PATENT AND TRADEMARK OFFICE

CERTIFICATE OF CORRECTION

PATENT NO. : 7,351,390 B2
APPLICATION NO. : 10/256224
DATED : April 1, 2008
INVENTOR(S) : Jean-Etienne Loncle et al.

It is certified that error appears in the above-identified patent and that said Letters Patent is hereby corrected as shown below:

Column 2, lines 50-54, please delete the paragraph beginning with "In another implementation..." in its entirety.

Signed and Sealed this

Nineteenth Day of May, 2009

JOHN DOLL
*Acting Director of the United States Patent and Trademark Office*